United States Patent [19]

Nishikawa et al.

[11] 4,277,550

[45] Jul. 7, 1981

[54] PHOTOSENSITIVE SCREEN FOR ELECTROGRAPHIC APPARATUS

[75] Inventors: Masaji Nishikawa; Norio Amemiya, both of Hachioji, Japan

[73] Assignee: Olympus Optical Company Limited, Tokyo, Japan

[21] Appl. No.: 25,597

[22] Filed: Mar. 30, 1979

Related U.S. Application Data

[63] Continuation of Ser. No. 820,027, Jul. 28, 1977, abandoned.

[30] Foreign Application Priority Data

Aug. 25, 1976 [JP] Japan ..... 51-100493

[51] Int. Cl.[3] ..... G03G 15/00; G03G 5/04

[52] U.S. Cl. ..... 430/68; 430/53; 355/3 SC

[58] Field of Search ..... 96/1 R, 1.5; 355/3 R, 355/3 SC; 430/53, 68

[56] References Cited

U.S. PATENT DOCUMENTS

| | | | |
|---|---|---|---|
| 3,942,980 | 3/1976 | Hou | 96/1.5 |
| 3,964,827 | 6/1976 | Tanaka | 96/1 R |
| 4,046,466 | 9/1977 | Ando et al. | 96/1 R |

*Primary Examiner*—Roland E. Martin, Jr.
*Assistant Examiner*—John L. Goodrow
*Attorney, Agent, or Firm*—Haseltine and Lake

[57] ABSTRACT

A photosensitive screen for an electrographic apparatus adapted to modulate a flow of corona ions by an electrostatic latent image produced thereon is disclosed. The photosensitive screen is composed of an electrically conductive mesh which is coated on one side with an insulating layer and an electrically conductive layer superimposed one upon the other in the order as mentioned and coated on the other side with a photosensitive layer.

The photosensitive screen comprises further an insulating thin film layer which covers at least the electrically conductive layer for the purpose of protecting it against surrounding atmosphere and hence improving durability thereof.

4 Claims, 5 Drawing Figures

PHOTOSENSITIVE SCREEN FOR ELECTROGRAPHIC APPARATUS

Figure 1A:
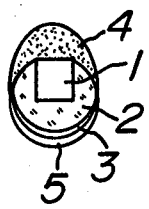

This is a continuation of application Ser. No. 820,027 filed July 28, 1977, now abandoned.

This invention relates to a photosensitive screen for an electrographic apparatus adapted to modulate a flow of ions by an electrostatic latent image produced thereon and more particularly to an improved construction of such photosensitive screen which can improve durability thereof.

Various kinds of photosensitive screens for an electrographic apparatus adapted to modulate a flow of corona ions by a first electrostatic latent image produced on the photosensitive screen in order to obtain a second electrostatic latent image on a dielectric record sheet have been well known.

In such kind of photosensitive screen, provision must be made of an electrically conductive member which is exposed toward a corona ion source for the purpose of absorbing those corona ions which have been prevented from being passed through the screen and hence rendering the modulation characteristic of the screen unchangeable. For this purpose, in general, in the case of coating on one side of the electrically conductive mesh with an insulating layer, if this insulating material becomes extended to and coated on the other side of the electrically conductive mesh, the insulating material is coated thereon with an electrically conductive thin film layer in order to remove the influence of the coated insulating material.

In addition, it has been well known to provide an electrically conductive mesh which is coated on its side facing toward a corona ion source with an insulating layer and an electrically conductive layer superimposed one upon the other in the order as mentioned for the purpose of accelerating or impeding passage of a flow of corona ions through the photosensitive screen. Such electrically conductive layer plays an extremely important role of improving ability of the photosensitive screen. Many attempts have been made to provide an electrically conductive layer having a sufficiently high durability, but hitherto none has led to fully satisfactory results.

In general, the electrically conductive layer is formed of a low melting point metal selected from the group consisting of Au, Ag, Al, In, Cu, Zn and Sn and vapor deposited on the insulating layer. Among these low melting point metals, Al, Cu, Zn and Sn which are cheap in price and easy in manufacture are not stable and tend to lose their electric conductivity due to a slight chemical change caused by change of surrounding atmosphere, thereby losing their ability.

An object of the invention, therefore, is to eliminate such disadvantage of an electrically conductive layer of a photosensitive screen and hence to provide a photosensitive screen for an electrographic apparatus which is provided with an electrically conductive layer coated thereon with a protective film and which has a high durability.

A feature of the invention is the provision of a photosensitive screen for an electrographic apparatus comprising of an electrically conductive mesh coated on one side with an insulating layer and an electrically conductive layer superimposed one upon the other in the order as mentioned and coated on the other side with a photosensitive layer, the improvement comprising further providing an insulating thin film layer covering at least the electrically conductive layer to protect it against the surrounding atmosphere and improve its durability.

Figure 1B:
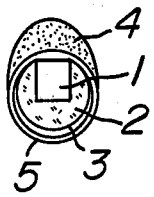
Figure 1C:
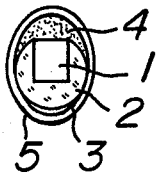
Figure 2A:
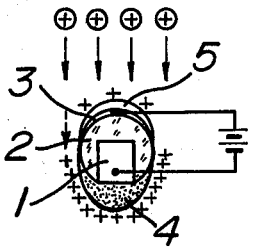
Figure 2B:
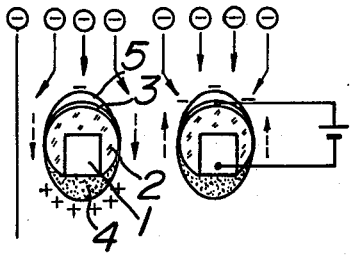

The invention will now be described in greater detail with reference to the accompanying drawings, wherein:

FIG. 1*a* is a cross sectional view of one embodiment of a photosensitive screen according to the invention;

FIG. 1*b* is a similar cross sectional view of another embodiment of a photosensitive screen according to the invention;

FIG. 1*c* is a similar cross sectional view of a further embodiment of a photosensitive screen according to the invention;

FIG. 2*a* is a schematic view illustrating a first charging step of the photosensitive screen shown in FIG. 1*a*; and FIG. 2*b* is a similar schematic view illustrating a second charging step of the photosensitive screen shown in FIG. 1*a*.

In FIG. 1*a* is shown one embodiment of a photosensitive screen according to the invention. The photosensitive screen shown in FIG. 1*a* is composed of an electrically conductive mesh 1 which is coated on one side with an insulating layer 2 and an electrically conductive layer 3 superimposed one upon the other in the order as mentioned and coated on the other side with a photosensitive layer 4. In the present embodiment, that surface of the electrically conductive layer 3 which makes contact with the surrounding atmosphere only is covered with an insulating thin film layer 5.

In FIG. 1*b* is shown another embodiment of a photosensitive screen according to the invention. In the present embodiment, the insulating thin film layer 5 is formed of a material which is the same as a barrier material for the photosensitive layer 4 and covers the total periphery of the electrically conductive mesh 1, insulating layer 2 and electrically conductive layer 3.

In FIG. 1*c* is shown a further embodiment of a photosensitive screen according to the invention. In the present embodiment, the insulating thin film layer 5 is formed of a material which is the same as a surface layer on the photosensitive layer 4 or an insulating material having a light transmission property and covers the total periphery of the electrically conductive mesh 1, insulating layer 2, electrically conductive layer 3 and photosensitive layer 4.

As described above, the insulating thin film layer 5 covering the electrically conductive layer 3 of the photosensitive screen shown in FIG. 1*b* may be formed of the barrier material for the photosensitive layer 4, while the insulating thin film layer 5 covering the electrically conductive layer 3 of the photosensitive screen shown in FIG. 1*c* may be formed of the material which is the same as that of the surface layer of the photosensitive layer 4. As a result, these photosensitive screens shown in FIGS. 1*b* and 1*c* can be manufactured in a simple manner. Particularly, in the case of forming the insulating thin film layer 5 shown in FIG. 1*b* by means of vapor phase polymerization, the insulating layer 2 and electrically conductive layer 3 superimposed one upon the other in the order as mentioned on one side of the electrically conductive mesh 1 may be uniformly coated with the insulating thin film layer 5 in a manner such that the insulating thin film layer 5 covers the insulating layer 2 and electrically conductive layer 3. In the case of forming the insulating thin film layer 5 shown in FIG. 1*c* by means of vapor phase polymerization, the photosensitive layer 4 coated on the other side of the electrically conductive mesh 1 may be uniformly coated with the insulating thin film layer 5 in a manner such that the insulating thin film layer 5 covers the photosensitive layer 4. As a result, these photosensitive screens shown in FIGS. 1*b* and 1*c* can be manufactured in a convenient manner. In addition, in the photosensitive screen shown in FIG. 1*c*, the insulating thin film layer 5 coated on the photosensitive layer 4 effectively functions to hold the electrostatic latent image produced thereon, so that it is preferable to use the photosensitive screen shown in FIG. 1*c* when a number of copies are prepared from one and same electrostatic latent image produced on the photosensitive screen.

The insulating thin film layer 5 may be formed of various kinds of inorganic compounds which can be vapor deposited such as $MgF_2$, $SiO_2$, SiO, etc., various kinds of resins which can be coated by spraying such as epoxy resin, acryl resin, polyamide resin, etc. or resins adapted to be formed by vapor phase polymerization such as xylene (made in U.S.A. by Union Carbide Co. and available in market in the trade name of Parylene), polymethyl methacrylate, poly-n-butyl methacrylate, polystyrene, paraxylene, tetrafluoroethylene, etc. Almost all of these materials function as the barrier material for the photosensitive layer 4 in the embodiment shown in FIG. 1*b* and function to hold the electrostatic latent image in the embodiment shown in FIG. 1*c*.

The operation of the photosensitive screen according to the invention will now be described with reference to FIGS. 2*a* and 2*b*. Use is made of a photosensitive screen having a cross sectional configuration shown in FIG. 1*a* and comprising a photosensitive layer 4 formed of Se or Se compound.

In FIG. 2*a* is shown a first charging step of uniformly charging the photosensitive layer 4. Between the electrically conductive mesh 1 and the electrically conductive layer 3 is applied a bias voltage and a flow of positive corona ions is directed toward the insulating thin film layer 5. As a result, the surface of the photosensitive layer 4 is uniformly charged up to a voltage value which is substantially equal to the bias voltage value. In this case, a positive charge is also accumulated on the insulating thin film layer 5 coated on the electrically conductive layer 3. The amount of the positive charge thus accumulated is changed in dependence with the thickness of the insulating thin film layer 5. The thicker the thickness of the insulating thin film layer 5 the larger the amount of the positive charge. That is, the insulating thin film layer 5 is charged up to a value determined by the charge holdability thereof.

The photosensitive layer 4 of the photosensitive screen charged as described above is illuminated by a light image. Then, in the second charging step shown in FIG. 2*b*, a flow of negative corona ions is directed toward the insulating thin film layer 5. In this case, the charge distribution on the photosensitive layer 4 modulated by the light image illumination and the bias voltage cause the electric field to act in the imagewise exposed area of the photosensitive screen in a direction of preventing the flow of ions therethrough and act in the imagewise dark area of the photosensitive screen in a direction of promoting the flow of ions therethrough. In addition, the electric charge accumulated on the insulating thin film layer 5 functions in a direction of intensifying the action of electric field produced by the bias voltage. In the imagewise exposed area of the photosensitive screen, the flow of negative ions is prevented from passing therethrough and functions to neutralize the electric charge on the insulating thin film layer 5 and accumulate the negative electric charge on the insulating thin film layer 5.

Experimental tests have yielded the result that the negative electric charge accumulated on the insulating thin film layer 5 functions to gradually eliminate the action of electric field produced by the bias voltage (this action will hereinafter be called as accumulation effect). As a result, in the case of preparing a number of copies from the one and same electrostatic latent image, the picture image concentration of a second copy becomes considerably higher than that of a first copy. In addition, the overdeveloped concentration becomes increased in accordance with the increase of the number of copies to be reproduced.

Inventors' experimental tests have demonstrated the result that the above described undesrious influence due to the accumulation effect could not be observed when the thickness of the insulating thin film layer 5 is small or negligibly small. The Parylene, etc. whose film thickness can be determined in a relatively easy manner may be used in practice even if its film thickness is smaller than several hundreds mμ. Good results are also obtained by using any other synthetic resins each having a film thickness of smaller than 1μ.

The effect of the photosensitive screen according to the invention will now be described with reference to the experimental results described in the following examples 1, 2 and 3 relating to conventional photosensitive screens and examples 4, 5 and 6 relating to the photosensitive screen according to the invention.

EXAMPLE 1

An electrically conductive mesh was coated on one side with an insulating layer formed of polyurethane resin and having a thickness of the order of 25μ by spraying. The insulating layer was coated thereon with an electrically conductive layer formed of Al and having a thickness of several tens mμ by vapor deposition. The electrically conductive mesh was coated on the other side with a photosensitive layer formed of Se and having a thickness of the order of 25μ by vapor deposition to provide a photosensitive screen. The photosensitive screen was remained in a chamber kept at a humidity of 90% and at a temperature of 50° C. for 100 hours. After the end of 100 hours, the Al vapor deposited layer (electrically conductive layer) was substantially completely disappeared.

EXAMPLE 2

An electrically conductive mesh was coated on one side with an insulating layer formed of polyurethane resin and having a thickness of the order of 25μ by spraying. The insulating layer was coated thereon with an electrically conductive layer formed of Al and having a thickness of several tens mμ by vacuum vapor deposition. The electrically conductive mesh was coated on the other side with a photosensitive layer formed of Se and having a thickness of the order of 25μ by vacuum vapor deposition to provide a photosensitive screen. The photosensitive screen was left as it is in air for about half a year. After the end of about half a year, the Al vapor deposited layer (electrically conductive layer) became dark in color and at the same time increased in electric resistance, thereby rendering its electric conductivity insufficient as an electrode.

EXAMPLE 3

An electrically conductive mesh was coated on one side with an insulating layer formed of polyurethane resin and having a thickness of the order of 25μ by spraying. The insulating layer was coated thereon with an electrically conductive layer formed of Al and Ag and having a thickness of several tens mμ by vacuum vapor deposition. The electrically conductive mesh was coated on the other side with a photosensitive layer formed of Se and having a thickness of the order of 25μ by vapor deposition to provide a photosensitive screen. The photosensitive screen was remained in an atmosphere having a humidity of 90% at a temperature of 50° C. for 100 hours. The Al vapor deposited layer was changed in property and floated off the electrically conductive mesh thus resulting into a condition in which the Al vapor deposited layer becomes peeled off from the electrically conductive mesh in an extremely easy manner.

Experimental tests have yielded the result that the photosensitive screen which makes use of an insulating thin film layer for covering at least the electrically conductive layer according to the invention can eliminate the above mentioned drawbacks which have been encountered with the prior art techniques as will be described with reference to the following examples 4, 5 and 6.

EXAMPLE 4

An electrically conductive mesh was coated on one side with an insulating layer formed on polyurethane resin and having a thickness of the order of 25μ. The insulating layer was coated thereon with an electrically conductive layer formed of Al and having a thickness of several tens mμ by vacuum vapor deposition. In the present example, the electrically conductive layer was coated thereon with an insulating thin film layer by the following method. Use was made of 6 to 10 cc of a liquid resin formed of 1 part by weight of silicone (made in Japan by Toyo Rayon Co., Ltd. and available in market by the trade name of SH 804) and 150 parts by weight of toluene. The liquid resin was uniformly coated on the electrically conductive layer for an area of 300 mm×450 mm and then dried.

The electrically conductive mesh was coated on the other side with a photosensitive layer formed of Se and having a thickness of the order of 25μ by vacuum vapor deposition. The photosensitive screen thus obtained is shown in FIG. 1*a*.

The photosensitive screen was mounted in an electrographic apparatus in the usual manner and used for a time longer than one year.

The electrically conductive layer formed of Al vapor deposition revealed no change and hence showed a good electric conductivity. In addition, the above mentioned accumulation effect of the insulating thin film layer was quite small and hence led to no failure in practice.

Between the Se photosensitive layer and the electrically conductive mesh was inserted the above described insulating thin film layer formed of the same amount of silicone resin. In this case, the dark decay characteristic of the photosensitive screen was significantly improved.

EXAMPLE 5

An electrically conductive mesh was coated on one side with an insulating layer formed of polyurethane and having a thickness of the order of 25μ. The insulating layer was coated thereon with an electrically conductive layer formed of Al and having a thickness of several tens mμ by vacuum vapor deposition. Around the total periphery of the above mentioned electrically conductive mesh, insulating layer and electrically conductive layer was covered an insulating thin film layer formed of parylene and having a thickness of several hundreds mμ by vapor phase polymerization. The electrically conductive mesh was coated on the other side with a photosensitive layer formed of Se and having a thickness of 25μ by vacuum vapor deposition to provide a photosensitive screen shown in FIG. 1*b*.

Experimental tests have shown the result that the photosensitive screen shown in FIG. 1*b* reveals substantially no accumulation effect, and that the parylene layer sandwiched between the Se photosensitive layer and the electrically conductive mesh contributes to significant improvement in the dark decay characteristic.

EXAMPLE 6

An electrically conductive mesh was coated on one side with an insulating layer formed of polyurethane resin and having a thickness of the order of 25μ by spraying. Around the total periphery of the electrically conductive mesh and the insulating layer was covered a first insulating thin film layer formed of parylene and having a thickness of several hundreds mμ. On that portion of the first insulating thin film layer which covers the above mentioned insulating layer was coated an electrically conductive layer formed of Al and having a thickness of several tens mμ by vapor deposition. The electrically conductive mesh was coated on the other side with a photosensitive layer formed of Se and having a thickness of the order of 25μ. Around the total periphery of the Se photosensitive layer and the Al electrically conductive layer was covered a second insulating layer formed of parylene and having a thickness of several hundreds mμ to provide a photosensitive screen shown in FIG. 1*d*. The second insulating layer also functions to protect both the Se photosensitive layer and the Al electrically conductive layer.

The photosensitive screen is provided with the parylene insulating layer superimposed on the Se photosensitive layer, so that it has an excellent electric charge holdability and can obtain a plurality of copies on the basis of one and same electrostatic latent image. In addition, the photosensitive screen of the present embodiment has substantially no accumulation effect and is not influenced by surrounding atmosphere.

At stated hereinbefore, in the photosensitive screen according to the invention, the electrically conductive layer exposed to atmosphere is covered by the insulating thin film layer. As a result, the insulating thin film layer functions to separate the electrically conductive layer from atmosphere and effectively prevent undesirous chemical change from being occurred, thereby maintaining significantly stable conductivity.

What is claimed is:

1. In a photosensitive screen for an electrographic apparatus comprising an electrically conductive mesh coated on one side with an insulating layer and an electrically conductive layer superimposed one upon the other in the order as mentioned and coated on the other side with a photosensitive layer, the improvement comprising: further providing an insulating thin film layer having a thickness of less than 1μ and covering at least that surface of said electrically conductive layer which makes contact with surrounding atmosphere to protect it against the surrounding atmosphere and improve its durability.

2. The photosensitive screen according to claim 1, wherein: said insulating thin film layer surrounds the total periphery of said electrically conductive mesh, insulating layer and electrically conductive layer.

3. The photosensitive screen according to claim 1, wherein: said insulating thin film layer is formed of a light transmission material and surrounds the total periphery of said electrically conductive mesh, insulating layer, electrically conductive layer and photosensitive layer.

4. The photosensitive screen according to claim 1, wherein: said electrically conductive layer is formed by vapor deposition.

* * * * *